US009375891B2

(12) United States Patent
Ki

(10) Patent No.: US 9,375,891 B2
(45) Date of Patent: Jun. 28, 2016

(54) SCRAP COMPACTOR AND APPARATUS FOR MANUFACTURING SAME

(75) Inventor: Joon-Seong Ki, Incheon (KR)

(73) Assignee: Hyundai Steel Company, Incheon (KR)

( * ) Notice: Subject to any disclaimer, the term of this patent is extended or adjusted under 35 U.S.C. 154(b) by 203 days.

(21) Appl. No.: 13/882,031

(22) PCT Filed: Aug. 30, 2011

(86) PCT No.: PCT/KR2011/006424

§ 371 (c)(1),
(2), (4) Date: Apr. 26, 2013

(87) PCT Pub. No.: WO2012/057447

PCT Pub. Date: May 3, 2012

(65) Prior Publication Data

US 2013/0220147 A1 Aug. 29, 2013

(30) Foreign Application Priority Data

Oct. 27, 2010 (KR) ..... 10-2010-0105295

(51) Int. Cl.

| | |
|---|---|
| ***B30B 9/30*** | (2006.01) |
| ***B30B 9/32*** | (2006.01) |
| ***B30B 1/32*** | (2006.01) |
| ***B30B 13/00*** | (2006.01) |
| ***B30B 15/02*** | (2006.01) |

(52) U.S. Cl.

CPC ..... *B30B 9/328* (2013.01); *B30B 9/327* (2013.01); *B30B 13/00* (2013.01); *B30B 15/02* (2013.01)

(58) Field of Classification Search

CPC ..... B30B 9/32; B30B 9/328; B30B 9/3014; B30B 9/3078; B30B 9/327; B30B 15/06; B30B 15/02; B30B 13/00

USPC ..... 100/35, 218, 232, 240, 244, 245, 264, 100/906, 295, 94, 98 R, 246; 425/139, 145, 425/149, 157, 165, 414, 415, 422; 75/353; 428/544

See application file for complete search history.

(56) References Cited

U.S. PATENT DOCUMENTS

| | | | | |
|---|---|---|---|---|
| 3,386,374 | A * | 6/1968 | Tezuka | B30B 9/301 100/215 |
| 3,577,912 | A * | 5/1971 | Busi | 100/218 |
| 4,103,610 | A * | 8/1978 | Vezzani | 100/232 |
| 4,755,332 | A * | 7/1988 | Mizuno et al. | 264/0.5 |
| 2012/0266724 | A1 * | 10/2012 | Lee | 75/770 |

FOREIGN PATENT DOCUMENTS

| | | |
|---|---|---|
| JP | 50-3028 | 1/1975 |
| JP | 53-053167 A | 5/1978 |

(Continued)

*Primary Examiner* — Jimmy T Nguyen

(74) *Attorney, Agent, or Firm* — Mintz Levin Cohn Ferris Glovsky and Popeo, P.C.; Kongsik Kim; Colleen H. Witherell

(57) ABSTRACT

A compactor and to an apparatus for manufacturing compressed scrap. The apparatus for manufacturing scrap compactors includes a core having a through-hole formed in a scrap compactor (S), thereby improving the melting behavior of the scrap compactor via the through-hole (h), and also has the effect of preventing the deliberate misrepresentation of the weight of the contents of the scrap compactor carried out by inserting heavy substances into the scrap compactor instead of scrap.

6 Claims, 6 Drawing Sheets

(56) References Cited

FOREIGN PATENT DOCUMENTS

| | | | |
|---|---|---|---|
| JP | 53-098170 | A | 8/1978 |
| JP | 02-165899 | A | 6/1990 |
| JP | 07-214384 | A | 8/1995 |
| JP | 2005-014072 | A | 1/2005 |
| KR | 10-1998-0077510 | A | 11/1998 |
| KR | 20-2009-0009739 | U | 9/2009 |

* cited by examiner

SCRAP COMPACTOR AND APPARATUS FOR MANUFACTURING SAME

CROSS-REFERENCES TO RELATED APPLICATIONS

This application is a U.S. national phase application, pursuant to 35 U.S.C. §371, of PCT/KR2011/006424, filed Aug. 30, 2011, designating the U.S. which claims priority to Korean Application No. 10-2010-0105295, filed Oct. 27, 2010. The entire contents of the aforementioned patent applications are incorporated herein by this reference.

TECHNICAL FIELD

The present invention relates generally to a compressed scrap and an apparatus for manufacturing the same and, more particularly, to a compressed scrap having improved melting behavior and being capable of preventing the massaging of the weight of the compressed scrap, and a manufacturing apparatus therefor.

BACKGROUND ART

As well known to those skilled in the art, electric furnaces use scrap, i.e., scrap metal.

Electric furnaces are charged with scrap and melt the scrap into molten steel by means of an electric arc generated by electrode rods.

The scrap is collected from domestic waste, construction waste, by-products of various manufacturing industries, and service life-expired waste materials.

SUMMARY OF THE DISCLOSURE

Accordingly, the present invention has been made keeping in mind the above problems occurring in the prior art, and an object of the present invention is to provide a compressed scrap capable of being smoothly melted in electric furnaces and preventing the massaging of the weight of the compressed scrap when scrap suppliers deliver the compressed scrap to electric furnace plants.

Another object of the present invention is to provide an apparatus for manufacturing the compressed scrap.

In order to accomplish the above objects, in an aspect, the present invention provides a compressed scrap including a hexahedral compressed body, wherein a through-hole passes through opposite faces thereof.

The hexahedral compressed body may be of a rectangular or regular hexahedron in shape.

The through-hole may consist of a plurality of through-holes perpendicular to each other, wherein each of the through-holes passes through the center of the compressed scrap.

In another aspect of the present invention, the present invention provides an apparatus for manufacturing a compressed scrap, including:

a housing defining a space for compressing scrap;

a support door fixedly insertable into the space through an outlet of the housing when compressing scrap and being removable from the space through the outlet to open the outlet when completing the compressing of the scrap;

a compressing plate insertable into the space through an inlet of the housing to compress the scrap, supplied into the space, against the support door to form the compressed scrap; and a core inserted into the space before the compressing of the scrap using the compressing plate, to form a through-hole in the compressed scrap when compressing the scrap.

The core may be disposed under the housing such that the core vertically reciprocates through an opening formed through a lower surface of the housing.

The core may be attached to a front surface of the support door.

The core may be of a cylindrical or conical shape.

The core may have a sectional area decreasing in size in the direction of a distal end thereof.

A pair of pressing plates may be disposed to face each other on the outside of the outlet of the housing to press and fix the compressed scrap discharged from the housing on opposite sides thereof.

A pair of cross-cores may be disposed on the outside of opposite housing walls such that the cross-cores approach each other perpendicular to and come into close contact with opposite surfaces of a circumference of the core that has been inserted into the space.

The compressing plate may be configured to advance toward the compressed scrap and discharge it out from the housing.

The housing may be configured to tilt to the outlet such that the compressed scrap is discharged out from the housing through the outlet.

As described above, the present invention facilitates the smooth heat transfer throughout the compressed scrap along the through-hole, having the effect of improving the melting behavior of the compressed scrap.

Further, the present invention facilitates the easy observation of the inside of the compressed scrap through the through-hole, having the effect of preventing the massaging of the weight of the compressed scrap, which is carried out by deliberately adding heavy weights that are other than scrap into the scrap when manufacturing the compressed scrap.

Furthermore, the present invention can manufacture the compressed scrap using the manufacturing apparatus.

DETAILED DESCRIPTION

The present invention will now be described with reference to the accompanying drawings.

Figure 1:
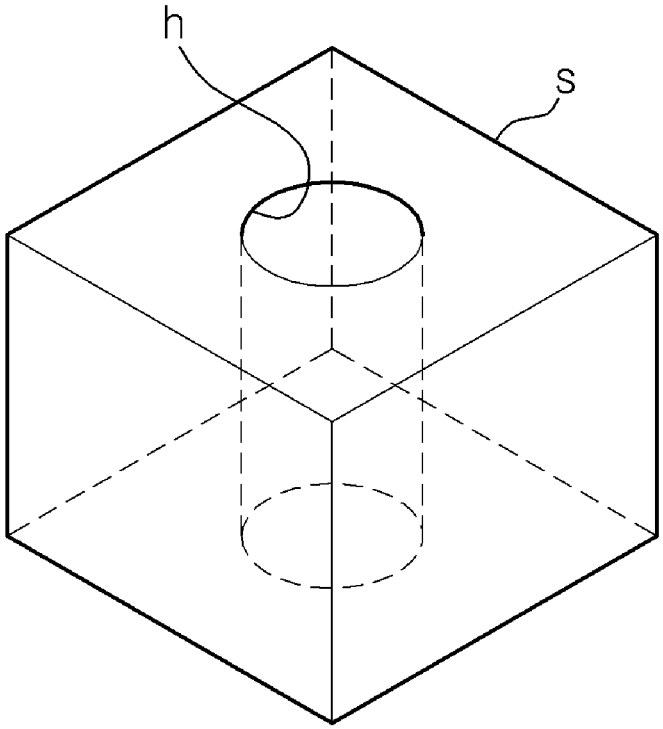
FIG. 1 is a perspective view of a compressed scrap according to the present invention.

As shown in FIG. 1, a compressed scrap S according to the present invention includes a rectangular (or regular) hexahedral body which is provided with a through-hole h.

The through-hole h passes through the center of the compressed scrap S.

The through-hole h formed in the compressed scrap S reduces the weight of the compressed scrap and thus facilitates the handling and delivery of the compressed scrap.

Particularly, when the compressed scrap is introduced into an electric furnace to be melted, the through-hole enables heat to be transferred directly throughout the inside of the compressed scrap to improve the melting behavior of the compressed scrap.

That is, heat from a heat source is not gradually transferred from the outer surface of the compressed scrap toward the center thereof, but is transferred directly to the inside of the compressed scrap, so that the compressed scrap is melted more efficiently and quickly.

Hence, the amount of electric power used in an electric furnace is reduced, resulting in reduced energy consumption and production cost.

Further, with the formation of the through-hole h, when suppliers deliver a compressed scrap to electric furnace plants, wrongdoing or massaging about the weight of the compressed scrap by adding separate weights other than iron component to the compressed scrap can be prevented.

That is, since such wrongdoing is generally carried out by deliberately adding separate weights into the center of the compressed scrap when compressing scrap, such that separate weights cannot be identified from the outside of the compressed scrap, when a through-hole has been formed through the compressed scrap, an inspector can easily inspect the inside of a product (compressed scrap) with the naked eye. Thus, the massaging of the weight by inclusion of foreign materials can be clearly prevented.

Figure 2:
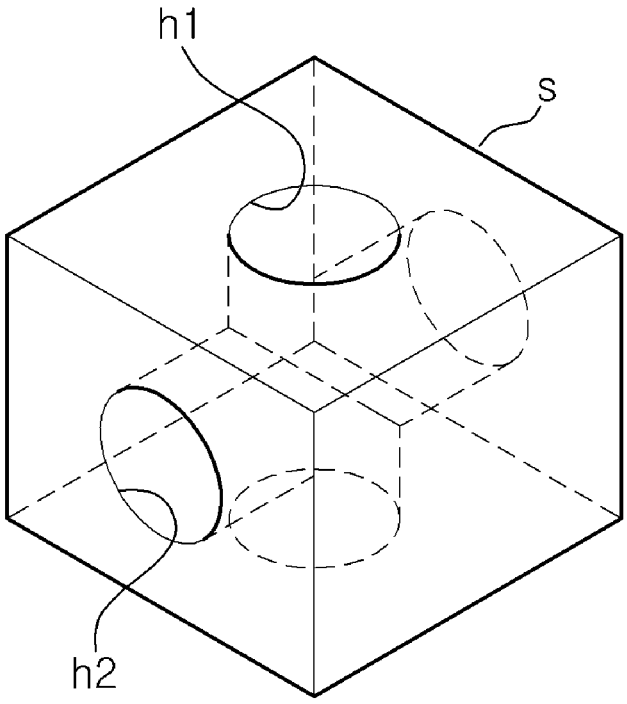
FIG. 2 is a perspective view of a compressed scrap according to another embodiment of the present invention.

In addition, the compressed scrap S may be provided with a plurality of through-holes h1 and h2 as shown in FIG. 2.

The plurality of through-holes h1 and h2 all pass through opposite faces of the compressed scrap S via the center thereof such that they are perpendicular to each other.

When the plurality of through-holes hl and h2 have been formed, heat transfer to the inside of the compressed scrap S is carried out more efficiently, improving the melting behavior, and it is difficult to hide separate foreign materials in the compressed scrap, clearly preventing the problem of the massaging in the weight of the compressed scrap S.

Now a description will be made of an apparatus for manufacturing the compressed scrap S.

Figure 3:
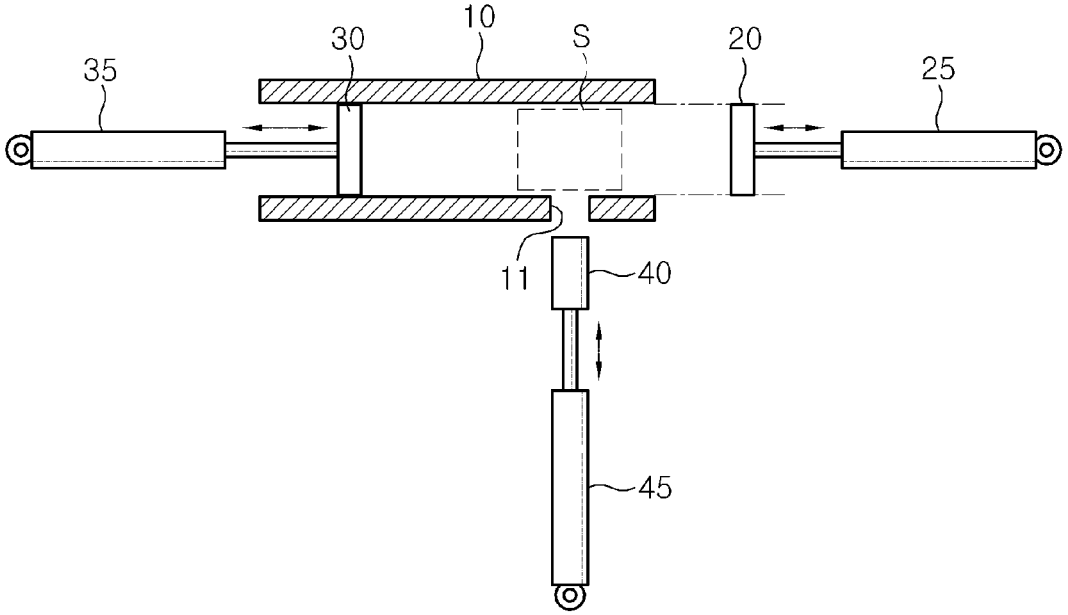
FIG. 3 is a constructional view (front view) of an apparatus for manufacturing a compressed scrap according to the present invention.
Figure 4:
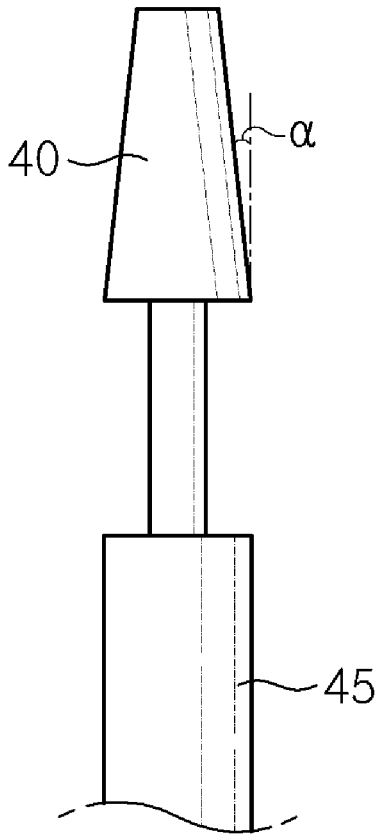
FIG. 4 is a view of a modified example of a core shown in FIG. 3.

As shown in FIG. 3, the apparatus includes a housing 10 which defines a space for compressing scrap, a support door 20 which is fixedly insertable into the space through an outlet (right opening in the drawing) of the housing 10 when compressing scrap and is removable from the space through the outlet to open the outlet when completing the compressing of the scrap, a compressing plate 30 which is insertable into the space through an inlet (left opening in the drawing) of the housing 10 to compress the scrap, which has already been supplied into the space, against the support door to form the compressed scraps, and a core 40 which is inserted into the space before the compressing of the scrap using the compressing plate 30, to form a through-hole h in the compressed scrap S when compressing the scrap.

The housing 10 has a hollow rectangular parallelepiped, opposite sides of which are open, wherein one side (the left side in the drawing) is used both as an inlet for scrap and an entrance for the compressing plate 30, and another side (the right side in the drawing) is used both as an outlet for a compressed scrap S and an entrance for the support door 20. In addition, the housing 10 may be separately provided on its upper surface with an opening door which is used as an inlet for scrap.

The support door 20, the compressing plate 30, and the core 40 are mounted to ends of cylinder rods of hydraulic cylinders 25, 35 and 45, respectively, so as to advance towards and retract from the inside of the housing 10.

The support door 20 and the compressing plate 30 are composed of a thick steel plate strong enough to withstand a compressed load of the scrap, and the surfaces thereof with which the scrap comes into direct contact are thermally treated to improve the surface hardness.

The core 40 has a cylindrical shape which is intended not to interfere with or to minimize an interruption of compressing movement of the scrap.

The compressing operation of the scrap is carried out as follows.

First, the support door 20 moves forward in the space of the housing 10 and is fixedly held at a certain position.

In addition, the core 40 is raised up completely into the space of the housing 10 through an entrance 11 formed on a lower surface of the housing 10, and is held in that state.

Next, scrap is introduced into the space of the housing through an inlet that is opposite the outlet or an entrance that is separately formed on the upper surface of the housing 10, and the compressing plate 30 is moved forward in the space of the housing 10.

Since a sectional area of the housing 10, a position at which the compressing plate 30 is stopped relative to the support door 20, and the corresponding amount of input scrap have already been determined, the compressing of the scrap will be completed at a point where the compressing plate 30 will have completed its advance. Thereby, a hexahedrally compressed scrap S is formed between the support door 20 and the compressing plate 30 in the space of the housing 10. That is, the compressing plate 30 presses against the support door 20, which is in a fixed state, in the space of the housing, so that scrap presented between the compressing plate and the support door in the space is compressed.

Here, as shown in FIG. 1, the through-hole h is formed in the hexahedral compressed scrap S while passing through the center thereof, by the core 40.

After the scrap has been compressed into a compressed scrap S, the core 40 moves down and then the support door 20 moves back to thereby open the outlet of the housing 10.

Next, the compressing plate 30 advances further to discharge the compressed scrap S out of the outlet.

The housing 10 may be configured to tilt such that the level of the outlet becomes lower than that of the inlet in order to allow the compressed scrap S to be discharged out by its own weight (since this configuration may be simply established by fixing one side of the housing 10 and inclining the other side of the housing 10 using an actuator, ordinary persons skilled in the art can implement this configuration with ease by selectively combining conventional constructions if needed, even though it is not shown in a separate drawing).

The finished compressed scrap may be conveyed using a vehicle or a table which is prepared in front of the outlet of the housing. In the case where the table is used, the compressed scrap is loaded on the table, which is conveyed using a crane. In this case, the through-hole h formed in the compressed scrap is used as a lifting eye.

In order to facilitate the removal of the core 40 from the compressed scrap S before the compressed scrap S is discharged out of the housing 10, the core 40 may have a frustoconical shape with a certain inclined angle (a). That is, the core has a diameter that decreases from a lower end thereof to an upper end thereof.

Hence, when the core escapes from the through-hole h of the compressed scrap S, friction with the surface of the compressed scrap is minimized, so that the core can be easily removed from the through-hole h of the compressed scrap.

Figure 5:
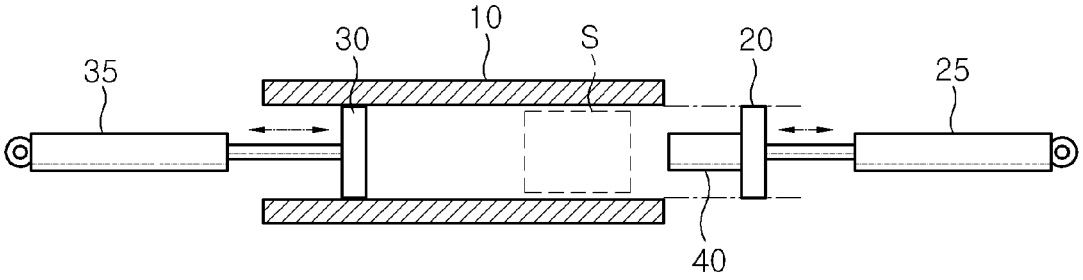
FIG. 5 is a constructional view (front view) of an apparatus for manufacturing a compressed scrap according to another embodiment of the present invention.
Figure 6:
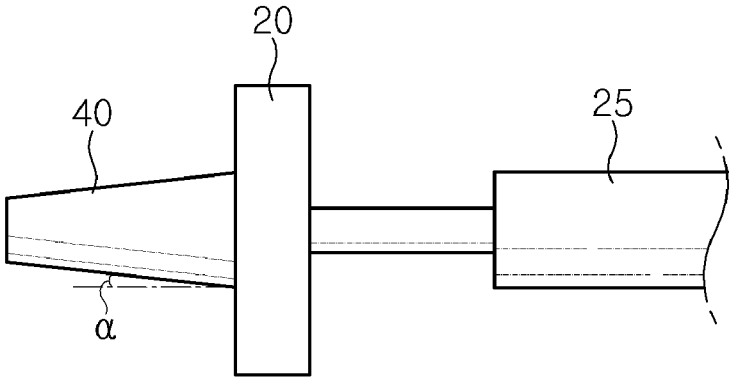
FIG. 6 is a view of a modified example of a core shown in FIG. 5.

Further, the core 40 may be disposed on a front surface of the support door 20 as shown in FIG. 5.

In this case, the core 40 moves in and out through the outlet of the housing 10, together with the support door 20, so that the housing 10 need not have a separate entrance 11 as shown in FIG. 3 on its lower side. Here, a separate hydraulic cylinder for actuating the core 40 is not also required.

In this configuration, the support door 20 and the core 40 are first inserted into the space of the housing 10 and are held at a predefined position, then scrap is introduced into the space of the housing 10, and the compressing plate 30 is moved forward to compress the scrap into a compressed scrap S.

Here, although a through-hole h is horizontally formed in the compressed scrap S, the direction of the through-hole h formed is not significant because the compressed scrap is of a hexahedral shape. That is, the compressed scrap S is of the same shape as those of the compressed scrap manufactured by the construction shown in FIG. 3.

On the one hand, also in an embodiment of FIG. 5, the core 40 preferably has a diameter that reduces from the rear portion to the front portion.

Such a shape may be a conical shape, for example.

Hence, after the scrap has completely been compressed, when the support door 20 is moved back, the core 40 is smoothly removed from the compressed scrap S.

Then, when the compressing plate 30 is further moved forward to push the compressed scrap S, the compressed scrap S is discharged from the housing.

Figure 7:
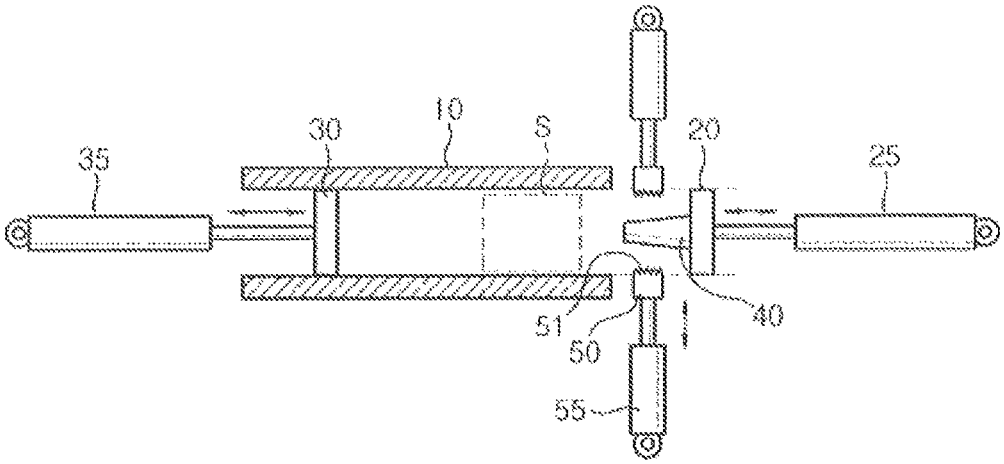
FIG. 7 is a view (plan view) of the apparatus of FIG. 5, wherein a fixing unit for a compressed scrap is further provided therein.

An apparatus shown in FIG. 7 is a construction that prepares the case when in the embodiment of FIG. 5, even though the core 40 is formed like a conical shape, the core 40 is not removed from the compressed scrap S, so the compressed scrap S is discharged in a state where it is combined with the core 40.

The embodiment of FIG. 7 is characterized in that it further includes a fixing unit for the compressed scrap as compared to the embodiment of FIG. 5.

The fixing unit includes a pair of pressing plates 50 which press against the opposite surfaces of the compressed scrap S combined with the core 40, and a pair of hydraulic cylinders 55 which reciprocates the pressing plates 50, respectively.

The pressing plate 50 may be provided on its leading surface with a plurality of pointed protrusions 51 to increase the fixing force for the compressed scrap S.

The pressing plates of the fixing unit are disposed on opposite sides of the housing such that they face each other, and are operated at the same time.

That is, when the compressed scrap S combined with the core 40 has been discharged, the opposite pressing plates are then moved forward each other to firmly grip the compressed scrap S. Subsequently, the support door 20 and the core 40 are further moved back, thereby separating the compressed scrap S and the core 40 from each other.

Then, the pressing plates 50 are moved back to their original positions, and as described before, the compressed scrap S is delivered.

Figure 8:
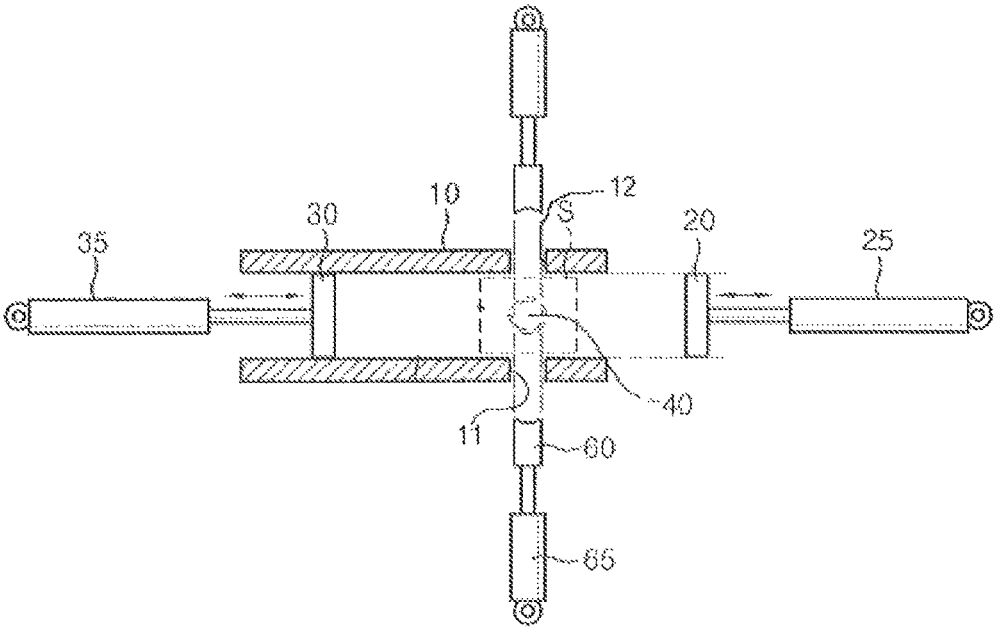
FIG. 8 is a constructional view (plan view) of an apparatus for manufacturing a compressed scrap according to still another embodiment of the present invention.

An apparatus of FIG. 8 is a construction that manufactures the compressed scrap S shown in FIG. 2 in which through-holes h1 and h2 that intersect with each other are formed.

FIG. 8 is a plan view of the apparatus (however, a housing is shown in section) which includes a core 40 which is disposed under the housing 10 such that it moves up and down as shown in FIG. 3. Here, the core 40 accesses to the inside of the housing 10 through an entrance 11 formed on a lower surface of the housing 10.

Cross-cores 60 in pair are disposed at a position lying on the same line with the core 40, on the outside of opposite housing walls. The cross-cores 60 are also mounted to the cylinder rods of the hydraulic cylinders 65, respectively. The cross-cores 60 may access to the inside of the housing 10 through an entrance 12 formed on the opposite housing walls.

Particularly, the leading surfaces (facing each other) of the cross-cores 60 are concavely formed to have the same curvature as a circumference of the core 40 such that they surround and come into close contact with opposite surfaces of the circumference of the core 40 which is mounted below the housing.

Hence, when the core 40 is moved up into the space of the housing and the opposite cross-cores 60 are moved forward each other toward the core 40, the cross-cores 60 perpendicularly meet the core 40 to form a cross line, thereby forming intersecting through-holes h1 and h2 in the compressed scrap S.

The effect of forming the intersecting through-holes h1 and h2 in the compressed scrap S has been described in respect of FIG. 2, so a repeated description thereof is omitted.

The invention claimed is:

1. An apparatus for manufacturing a compressed scrap, comprising:

a housing defining a space for compressing a scrap supplied therein;

a support door coupled to an end of a cylinder rod of a hydraulic cylinder that can be inserted into the space through an outlet of the housing and can be fixedly held at a certain position and can be removed from the space through the outlet such that the outlet is opened;

a compressing plate that can be inserted into the space through an inlet of the housing and can press against the support door such that the scrap is compressed by the support door and the compressing plate;

a core that can be inserted into the space before the scrap is compressed to form a through-hole in the scrap; and wherein the core is disposed under the housing such that the core vertically reciprocates through an opening formed through a lower surface of the housing, wherein a pair of cross-cores is disposed outside of opposite housing walls such that the cross-cores can approach each other to come into contact with opposite side surfaces of the core having been inserted into the space.

2. A method of manufacturing a compressed scrap, the method comprising:

moving a hydraulic support door into a housing to close one side of the housing; moving a hydraulic core into a scrap-compressing space in the housing;

introducing a predetermined amount of scrap into the housing based on a size of the scrap-compressing space;

moving a hydraulic compressing plate into the housing to close the other side of the housing;

moving the compressing plate to compress the scrap in the scrap-compressing space once the core has been inserted into and is being held in the scrap-compressing space, to form the compressed scrap having a through-hole extending through a center thereof;

moving the core backward and out from the scrap-compressing space after the compressing of the scrap has been completed; and discharging the compressed scrap from the housing.

3. The method as set forth in claim 2, further comprising a stage of inserting a pair of hydraulic cross cores into the scrap-compressing space in a direction toward the core inserted into the space and maintaining that state before the compressing plate is moved forward to compress the scrap, to form a cross type core structure with the core in the housing.

4. A method of manufacturing a compressed scrap, the method comprising:

moving a hydraulic compressing plate into a housing to close one side of the housing;

moving a hydraulic support door into the housing to close the other side of the housing;

moving a hydraulic core into a scrap-compressing space in the housing;

introducing a predetermined amount of scrap into the housing through an opening formed on an upper surface of the housing, based on a size of the scrap-compressing space, closing the opening formed on the housing;

moving the compressing plate to compress the scrap in the scrap-compressing space once the core has been inserted into and is being held in the scrap-compressing space, to form the compressed scrap having a through-hole extending through a center thereof;

moving the core backward and out from the scrap-compressing space after the compressing of the scrap has been completed; and discharging the compressed scrap from the housing.

5. The method as set forth in claim 4, further comprising a stage of inserting a pair of hydraulic cross cores into the scrap-compressing space in a direction toward the core inserted into the space and maintaining that state before the compressing plate is moved forward to compress the scrap, to form a cross type core structure with the core in the housing.

6. An apparatus for manufacturing a compressed scrap, comprising:

a housing defining a space for compressing a scrap supplied therein;

a support door that can be inserted into the space through an outlet of the housing and can be fixedly held at a certain position and can be removed from the space through the outlet such that the outlet is opened;

a compressing plate that can be inserted into the space through an inlet of the housing and can press against the support door such that the scrap is compressed by the support door and the compressing plate;

a core that can be inserted into the space before the scrap is compressed to form a through-hole in the scrap;

wherein the core is disposed under the housing such that the core vertically reciprocates through an opening formed through a lower surface of the housing; and wherein a pair of cross-cores is disposed outside of opposite housing walls such that the cross-cores can approach each other to come into contact with opposite side surfaces of the core having been inserted into the space.

* * * * *